US005590553A

United States Patent [19]

Pinckney et al.

[11] Patent Number: 5,590,553

[45] Date of Patent: Jan. 7, 1997

[54] CARRIER FOR SUPPORTING TEXTILE MATERIAL PACKAGES IN A WET TREATMENT MACHINE AND PACKAGE RETAINING CAP FOR SAME

[75] Inventors: Clarence D. Pinckney, Stanley, N.C.; Vladimir M. Gerasimov, St. Petersburg, Russian Federation; Mark G. Barkan; David R. Crawford, both of Stanley, N.C.

[73] Assignee: Gaston County Dyeing Machine Company, Stanley, N.C.

[21] Appl. No.: 402,812

[22] Filed: Mar. 13, 1995

[51] Int. Cl.[6] ..... D06B 5/18; D06B 23/00

[52] U.S. Cl. ..... 68/212; 68/198; 242/597.4

[58] Field of Search ..... 68/189, 198, 212; 242/597.4, 118.41

[56] References Cited

U.S. PATENT DOCUMENTS

| | | | |
|---|---|---|---|
| 632,317 | 9/1899 | Middleton et al. . | |
| 1,334,526 | 3/1920 | Dudley . | |
| 1,511,380 | 11/1923 | Traver . | |
| 2,125,937 | 8/1938 | Little et al. . | |
| 2,302,326 | 11/1942 | Kehor et al. . | |
| 2,437,987 | 3/1948 | Wolfenden . | |
| 2,562,220 | 7/1951 | Stienen . | |
| 2,679,153 | 5/1954 | Annicq . | |
| 2,713,347 | 7/1955 | Hazy . | |
| 3,225,573 | 12/1965 | Johnels . | |
| 3,344,622 | 10/1967 | Kronsbein . | |
| 3,433,432 | 3/1969 | Willis . | |
| 3,438,071 | 4/1969 | Clark . | |
| 3,596,481 | 8/1971 | Wilcox . | |
| 3,731,502 | 5/1973 | Stearns et al. . | |
| 3,777,516 | 12/1973 | Tigges | 68/198 |
| 4,452,055 | 6/1984 | Lejeune et al. . | |
| 4,720,986 | 1/1988 | Fuchs et al. . | |
| 4,825,668 | 5/1989 | Villard et al. . | |
| 4,884,418 | 12/1989 | Barriquand et al. . | |
| 5,172,443 | 12/1992 | Christ . | |
| 5,442,939 | 8/1995 | Crawford et al. | 68/198 |
| 5,477,709 | 12/1995 | Rowe | 68/198 X |

FOREIGN PATENT DOCUMENTS

| | | | |
|---|---|---|---|
| 29708 | 8/1907 | Austria . | |
| 0110058 | 1/1987 | European Pat. Off. . | |
| 0279009 | 8/1988 | European Pat. Off. | 68/212 |
| 468566 | 1/1992 | European Pat. Off. . | |
| 35694 | 7/1886 | Germany . | |
| 465628 | 9/1928 | Germany . | |
| 1039463 | 9/1958 | Germany . | |
| 1962576 | 6/1971 | Germany | 68/198 |
| 2039097 | 2/1972 | Germany | 68/212 |
| 2165540 | 7/1973 | Germany . | |
| 2558440 | 6/1977 | Germany | 68/212 |
| 649591 | 11/1962 | Italy | 68/198 |
| 156359 | 1/1921 | United Kingdom . | |
| 1018580 | 1/1966 | United Kingdom . | |
| 2062036 | 5/1981 | United Kingdom . | |

*Primary Examiner*—Philip R. Coe
*Attorney, Agent, or Firm*—Shefte, Pinckney & Sawyer

[57] ABSTRACT

Textile yarn package supporting carriers are disclosed for use in textile dyeing machines to enable the machine to be effectively operated at less than full capacity. Each carrier has a base with multiple upstanding package supporting posts each having a longitudinal package supporting portion extending upwardly from the base and dimensioned to securely support a predetermined maximum number of packages on each post. A cap mounts to the spindle portion of each post for movement therealong into engagement with the outermost package on the post. The cap has a latching arrangement with a latch plate disposed to be selectively movable between a disengaged or release position wherein the latch plate does not impede relatively free sliding movement of the cap along the post and a second engaged position wherein the latch plate is braced against the post to prevent sliding movement of the cap along the post.

10 Claims, 5 Drawing Sheets

CARRIER FOR SUPPORTING TEXTILE MATERIAL PACKAGES IN A WET TREATMENT MACHINE AND PACKAGE RETAINING CAP FOR SAME

BACKGROUND OF THE INVENTION

The present invention relates generally to textile wet treatment machines and more particularly to a carrier for supporting packages of textile material during processing in a wet treatment machine such as, for example, textile yarn package dyeing machines and to a novel package retaining cap for use with such carrier.

Textile package dyeing machines normally have a cylindrical pressurizable vessel into which packages of textile material to be wet processed, e.g., yarn packages wound on cylindrical spools, are arranged in vertical stacks on supporting vertical tubes arranged in spaced relation over the interior of the dye vessel. Such dyeing machines basically are of two types, commonly referred to as vertical dyeing machines, i.e., wherein the cylindrical vessel is oriented vertically with an openable lid at the upper end of the vessel for vertical insertion and removal of yarn packages to be dyed, and horizontal dyeing machines, wherein the cylindrical vessel is oriented horizontally with an openable lid at one end for horizontal insertion and removal of yarn packages to be dyed.

In both horizontal and vertical dyeing machines, it is conventional practice to support the yarn packages on a removable carrier which, in the case of vertical machines, can be lifted and lowered and, in the case of horizontal machines, can be horizontally transported on tracks or conveyors, for inserting and removing the yarn packages into and from the dye vessel. Conventional carriers of this type basically comprise a base with a plurality of upstanding tubes mounted in a spaced arrangement to the base. Yarn packages are slidably mounted over the upper ends of the tubes in a stacked arrangement and are secured by a cap threaded onto a compatibly threaded upper end portion of each tube. The upstanding tubes are hollow and perforated and communicate with concentric openings formed through the base to permit dye liquor to flow axially through the tubes and radially through the yarn packages.

While such carriers function satisfactorily and advantageously when supporting a full capacity of yarn packages, difficulties are encountered in dyeing smaller lots of yarn packages which do not require each tube to be fully stacked with yarn packages. In such cases, it is highly undesirable to fill the dye vessel with dye liquor to the same volume utilized when dyeing a full capacity of yarn packages. Accordingly, the volume of the dye bath is reduced commensurate with the number of yarn packages actually being dyed, but, since the lesser volume of the dye bath will result in the level of the bath being below the upper end of the perforated package-supporting tubes, appropriate measures must be taken to cover the exposed perforations. Conventionally, this is accomplished in one of two manners, either by placing a tubular cover over the exposed length of each perforated tube to block the perforations in the tube or by situating one or more volumetric displacement elements within the carrier or otherwise within the dye vessel to raise the level of the lesser volume of dye liquor to the level occupied during full capacity dyeing. Disadvantageously, however, volumetric displacers increase the risks of potential contamination of the dye liquor, while the tubular covers may not fully seal the exposed perforations in the package-supporting tubes, thereby risking the possibility that may be drawn into the pump of the dyeing machine used for circulating the dye liquor.

An alternative form of textile package carrier is disclosed in pending U.S. patent application Ser. No. 08/134,912, filed Apr. 12, 1993, and now U.S. Pat. No. 5,442,939 entitled CARRIER FOR SUPPORTING TEXTILE MATERIAL IN A WET TREATMENT MACHINE. The carrier of such invention utilizes a plurality of posts extending upwardly from a carrier base with each post having a longitudinal package supporting portion adjacent the base of sufficient length to support a minimum number of textile packages and a longitudinal spindle portion extending outwardly from and in alignment with the package supporting portion. Any selected one of several available package supporting adapters of varying lengths may be placed about the spindle portion of each post, or alternatively adapters may be omitted from each spindle portion, to give the carrier the ability to selectively support differing numbers of packages about the posts as determined by the absence of, or the presence and length of, package adapters on the posts. A conventional form of package retaining cap is threadedly mounted on the spindle portion of each post and advanced along the length thereof sufficiently to rest in retaining engagement with the uppermost package mounted on the post. In this manner, the carrier is enabled to be used for wet processing operations with less than a full capacity of textile packages, but without the necessity of utilizing blocking covers or volumetric displacer elements as in the prior art.

SUMMARY OF THE INVENTION

It is a fundamental object of the present invention to further improve on the package carrier of above-described U.S. patent application Ser. No. 08/134,912 to enable even greater ability for diverse numbers of textile yarn and like material packages to be selectively supported during wet processing operations without the disadvantages of the conventional techniques described above. A specific object of the invention is to provide a novel, simplified and improved package retaining cap to replace the conventional form of threadedly mounted cap used in the prior art.

Briefly summarized, the carrier of the present invention basically includes a base and one or more post assemblies extending outwardly from the base for mounting selectively differing numbers of the textile material packages in series about each post to be centrally supported thereabout. A package retaining cap is provided for mounting on each post. According to the present invention, the cap is provided with latching means selectively movable between a disengaged condition wherein the cap is permitted to be slidably mounted to and demounted from the post for selective slidable positioning movement along the post to differing package retaining positions therealong into and out of engagement with the outermost one of the annular textile material packages supported on the post and an engaged condition wherein the cap is securely retained against unintended sliding movement along the post during a wet treatment operation.

Thus, by the selective disposition of the caps on the respective posts, the package supporting capacity of the carrier can be readily varied, in turn enabling a corresponding reduction to be achieved in the required volume of processing liquid in the wet treatment machine without risk of contamination or risk of drawing into the pump of the machine.

In accordance with the preferred embodiment of the present invention, the latching means of the cap comprises a latch plate disposed to be selectively movable between a first position in the disengaged condition of the latching means wherein the latch plate does not impede relatively free sliding movement of the cap along the post and a second position in the engaged condition of the latching means wherein the latch plate is braced against the post to prevent sliding movement of the cap along the post. Preferably, the cap comprises a base having an opening for receiving the post and the latch plate has an opening for receiving the post, the latch plate in its first position being disposed in spaced parallel relation to the base with their respective openings aligned with one another for relatively free sliding movement of the cap along the post and in its second position being disposed in a sufficiently angular relation to the base to be braced against the post at the opening in the latch plate to prevent sliding movement of the cap along the post. The respective openings in the base and the latch plate of the cap conform closely to the configuration of the post.

Preferably, the base of the carrier includes a liquid flow opening for each post and each post includes an annular mounting portion affixed to the base about the liquid flow opening for liquid communication therethrough with the annular interior of the textile packages supported on the posts. For example, in one embodiment, threaded bores in the base define the liquid flow openings and the mounting portions of the posts are in the form of threaded tubes compatibly engageable in the threaded bores.

Each post is configured to permit liquid flow axially through the annular interior of the textile packages. For example, each post may comprise a plurality of radially outwardly extending package supporting struts.

Carriers in accordance with the present invention may be appropriately configured in differing embodiments for use in either horizontal-type wet treatment machines or vertical-type wet treatment machines.

DESCRIPTION OF THE PREFERRED EMBODIMENT

Figure 1:
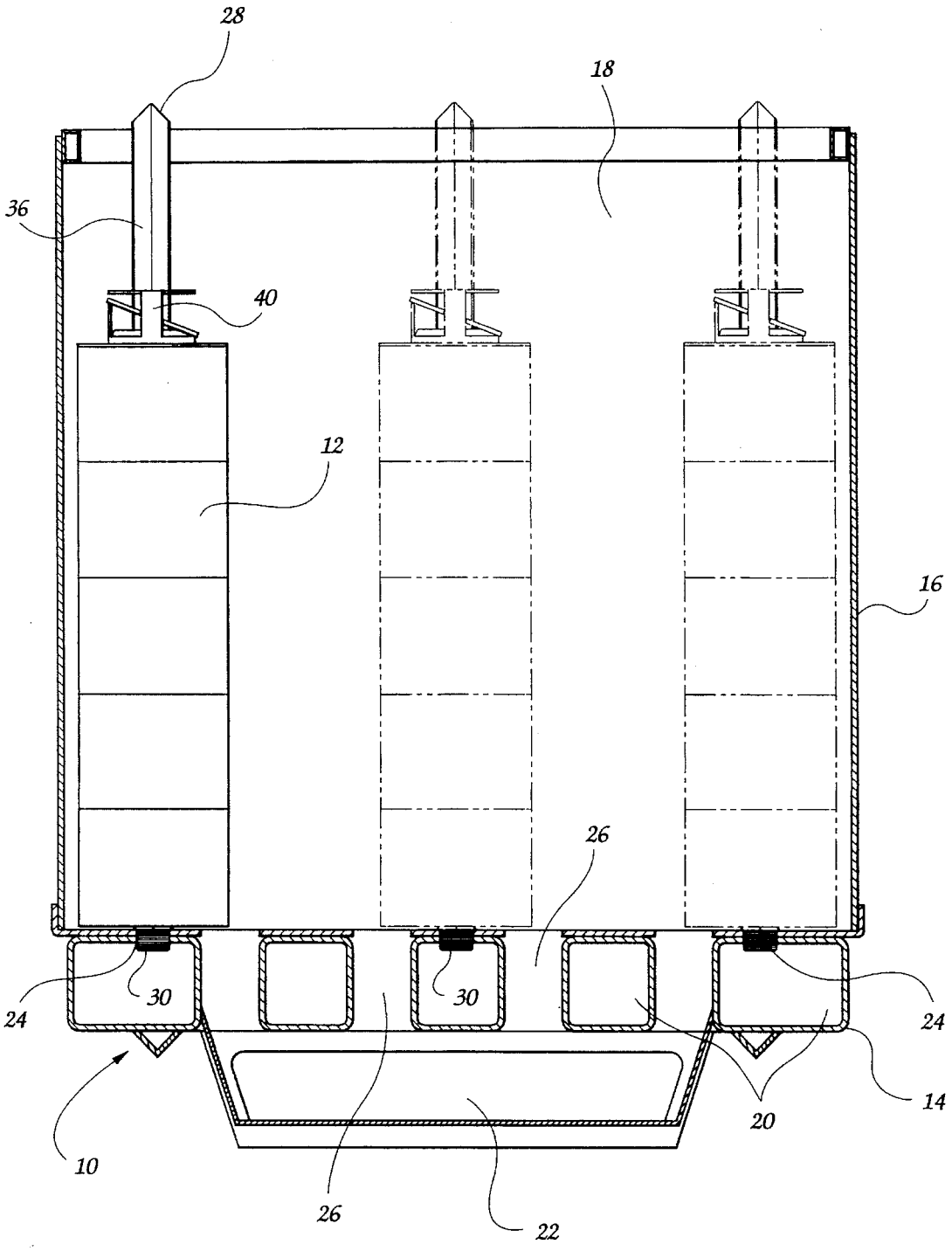
FIG. 1 is a vertical cross-sectional view of a carrier for supporting textile yarn packages for insertion into a textile wet treatment machine of the horizontal dyeing machine type, in accordance with one preferred embodiment of the present invention.

Referring now the accompanying drawings and initially to FIG. 1, a carrier 10 is shown according to a preferred embodiment of the present invention adapted for supporting textile material in the form of yarn packages 12 for transport to and from a horizontal type textile wet treatment machine in the form of a horizontal package dyeing machine (not shown). As illustrated, the carrier 10 is loaded with the yarn packages 12 to less than full capacity in accordance with the present invention, as more fully described hereinafter.

As is conventional, the carrier 10 is independently movable on a conventional carrier transport assembly (not shown), preferably an arrangement of one or more conveyor belts and/or tracks, for transporting the carrier 10 to and from the dyeing machine, which may be located in an arrangement of multiple dyeing machines commonly served by the same carrier transport assembly.

The carrier 10 basically includes a base structure 14 which serves both to support the yarn packages 12 and as a liquid flow assembly for delivery and withdrawal of treating liquid, e.g., a dye liquor, bleaching solution, water wash, or other appropriate treating fluid, to and through the carrier 10. The base structure 14 is preferably rectangular in overall horizontal cross-section. An upstanding wall 16 having four substantially flat planar sides is affixed to the base structure 14 to extend upwardly from its periphery and thereby forms with the base structure 14 an enclosure 18 for retaining the treating liquid during wet treatment of the yarn packages 12 therein. The top of the carrier's enclosure 18 is open for ease of loading thereinto and unloading therefrom the yarn packages 12.

The liquid flow arrangement formed by the base structure 14 includes two liquid distribution chambers 20,22 formed within the base structure 14 and communicating with the enclosure 18 defined by the base structure 14 and the wall 16, one of the liquid distribution chambers 20,22 serving to deliver treating liquid into the enclosure 18 and the other serving to withdraw treating liquid from the enclosure. Each of the chambers 20,22 extends through substantially the full horizontal extent of the base structure 14 with the chamber 20 disposed above the chamber 22. The upper chamber 20 communicates with the enclosure 18 through openings 24 formed in the top of the base structure 14, while the lower chamber 22 communicates with the enclosure 18 through elongated passages 26 which extend from the lower chamber 22 upwardly through the upper chamber 20.

Each chamber 20,22 has end openings (not shown) at each opposite end of the base structure 14 for communicating with corresponding openings of the chambers of an adjacent carrier 10 disposed in the vessel of the wet treatment machine or, alternatively, with ports of a duct assembly formed in the machine for supplying liquid to and withdrawing liquid from the interior of the machine in a conventional manner.

The carrier 10 is equipped with a plurality of upstanding post assemblies 28, only three of which are shown in FIG. 1, which are mounted to and extend upwardly from the base structure 14 for the purpose of supporting and retaining on each post assembly 28 a stacked column of multiple yarn packages 12. The post assemblies 28 are arranged in longitudinally extending rows spaced sufficiently from one another both longitudinally and transversely within the carrier enclosure 18 to permit non-interfering vertical stacking of the packages 12 thereon.

Figure 2:
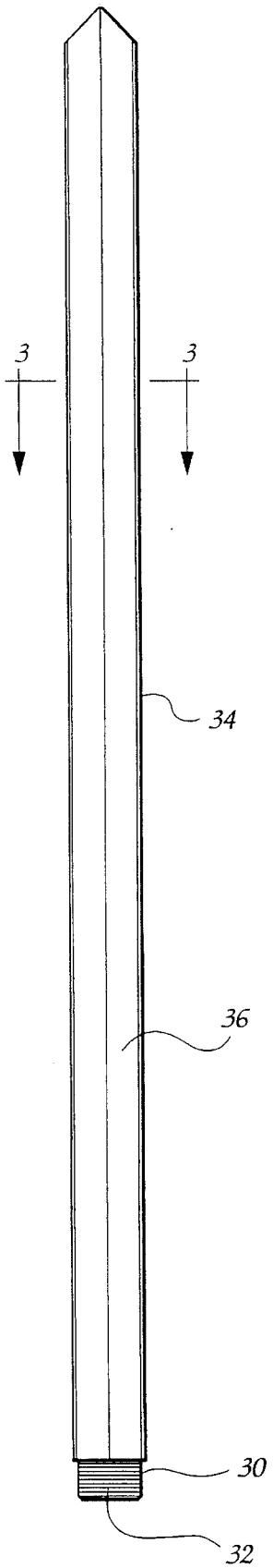
FIG. 2 is a side elevational view of one post assembly of the carrier of FIG. 1.
Figure 3:
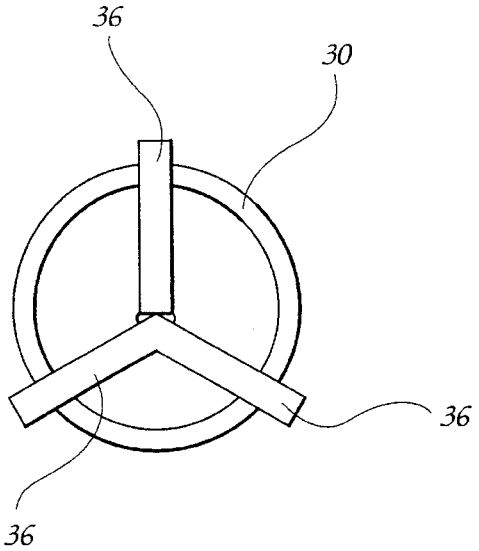
FIG. 3 is a horizontal cross-sectional view of the post assembly of FIG. 2, taken along line 3—3 thereof.

Each post assembly 28 is mounted to the base structure 14 in a manner permitting liquid communication between the liquid flow assembly of the base structure 14 and the annular interior of the yarn packages 12. For this purpose, each post assembly 28 is constructed as shown in FIGS. 2 and 3 with a lower tubular mounting portion 30 having external threads 32 and each liquid opening 24 in the top of the base structure 14 is correspondingly threaded internally for threaded mounting of each post assembly 28 co-axially within a respective liquid opening 24 in the base structure 14 for communication through the tubular mounting portion 30 with the liquid distribution chamber 20. Each post assembly 28 has an elongate package supporting portion 34 extending substantially the full length of the post assembly 28, formed by three lengthwise struts 36 projecting radially outwardly from one another at equal angular spacings and affixed at one end co-axially to the upper annular edge of the mounting portion 30 of the respective post assembly 28, as best seen in FIG. 3.

The radially transverse dimension of the struts 36 of the package supporting portion 34 are selected to correspond to the inside diameter of a textile yarn package 12 so that a package placed about the package supporting portion 34 of any post assembly 28 will be securely supported by the struts 36 against undesirable lateral movement relative to the post assembly 28. Similarly, the lengthwise dimension of the package supporting portion 34 is selected to correspond to the stacked dimension of a certain number of the packages 12 which has been predetermined to be the maximum number of packages to be supported on each post assembly 28 during any dyeing operation. By way of example, the lengthwise dimension of the struts 36 in the illustrated embodiment is sufficient for laterally supporting a column of six stacked yarn packages 12 on each post assembly 28, although those persons skilled in the art will readily recognize that the package supporting portion 34 may be of any other selected longitudinal dimension as may be desirable.

Figure 4:
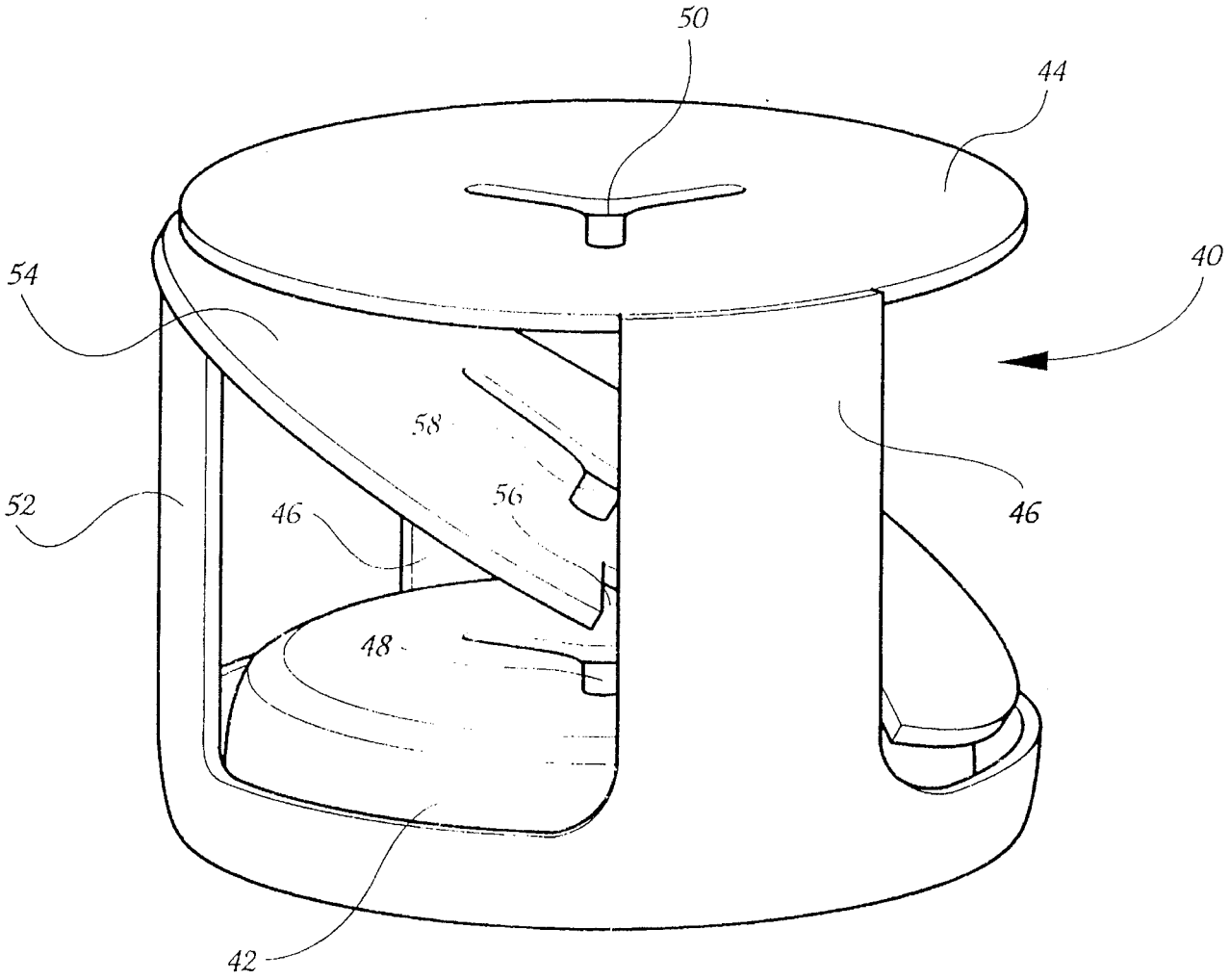
FIG. 4 is a perspective view of one package retaining cap of the carrier of FIG. 1.
Figure 5:
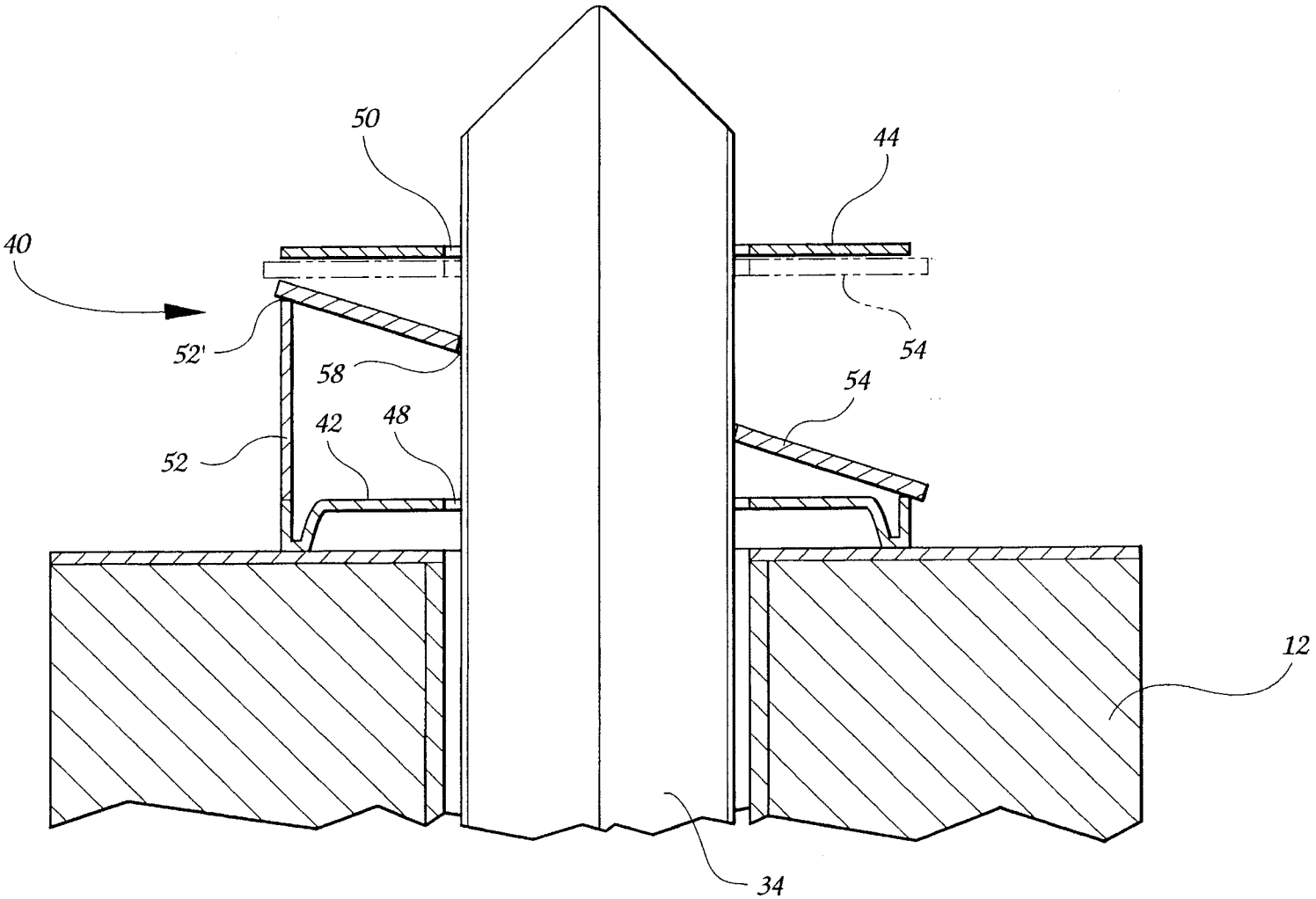
FIG. 5 is an enlarged vertical cross-sectional view taken through one post and its associated cap in the carrier of FIG. 1.

Each post assembly 28 is provided with a packaging retaining cap 40 best seen and understood with reference to FIGS. 4 and 5. Each package retaining cap 40 includes a circular base plate 42 and a correspondingly circular top plate 44 affixed coaxially together in spaced parallel relation by a pair of connecting bars 46 affixed to and extending transversely between the respective peripheries of the base and top plates 42,44 at diametrically opposed locations thereon. Respective Y-shaped openings 48,50 are formed in alignment with one another at the centers of the base and top plates 42,44, the Y-shaped openings 48,50 being configured and dimensioned in close conformity to the struts 36 of the post assemblies 28 for sliding receipt thereof through the openings 48,50.

The cap 40 also has a fulcrum bar 52 affixed to the periphery of the base plate 42 substantially circumferentially midway between the connecting bars 46 and extending therefrom perpendicularly toward the top plate 44, but terminating at a free upper end edge 52' at a short spacing from the periphery of the top plate 44. A correspondingly circular latching plate 54 is disposed between the base and top plates 42,44, with its periphery disposed between the fulcrum bar 52 and the top plate 44 and with diametrically opposed recesses 56 in the latching plate 54 receiving the respective connecting bars 46. In this manner, the latching plate 54 is disposed for pivoting movement about the edge 52' of the fulcrum bar 52 and under the guidance of the connecting bars 46 between a release position wherein the latching plate 54 is substantially parallel to the base and top plates 42,44 in face abutment with the underside of the top plate 44, shown in broken lines in FIG. 5, and a latching position wherein the latching plate 54 extends angularly downwardly from the edge 52' of the fulcrum bar 52 into edge abutment with the base plate 42 at the diametrically opposite side of the latching plate 44, as shown in full lines in FIG. 5. A Y-shaped opening 58 is also formed in the latching plate 54 at its center to be in substantially precise alignment with the corresponding openings 48,50 in the base and top plates 42,44 when the latching plate 54 is in its release position.

As will thus be understood, each cap 40 may be readily placed slidably on and advanced slidably along the package supporting portion 34 of an associated post assembly 28 while the latching plate 54 is held in its release position. However, when the latching plate 54 is released from such position, it pivots gravitationally into the latching position, thereby angularly moving its Y-shaped opening 58 out of alignment with the corresponding openings 48,50 in the base and top plates 42,44, whereby the latching plate 54 braces against the struts 36 of the post assembly 28 to essentially lock the cap 40 at the braced location against further sliding movement along the post assembly without manual lifting of the latching plate 54 into its release position.

Figure 6:
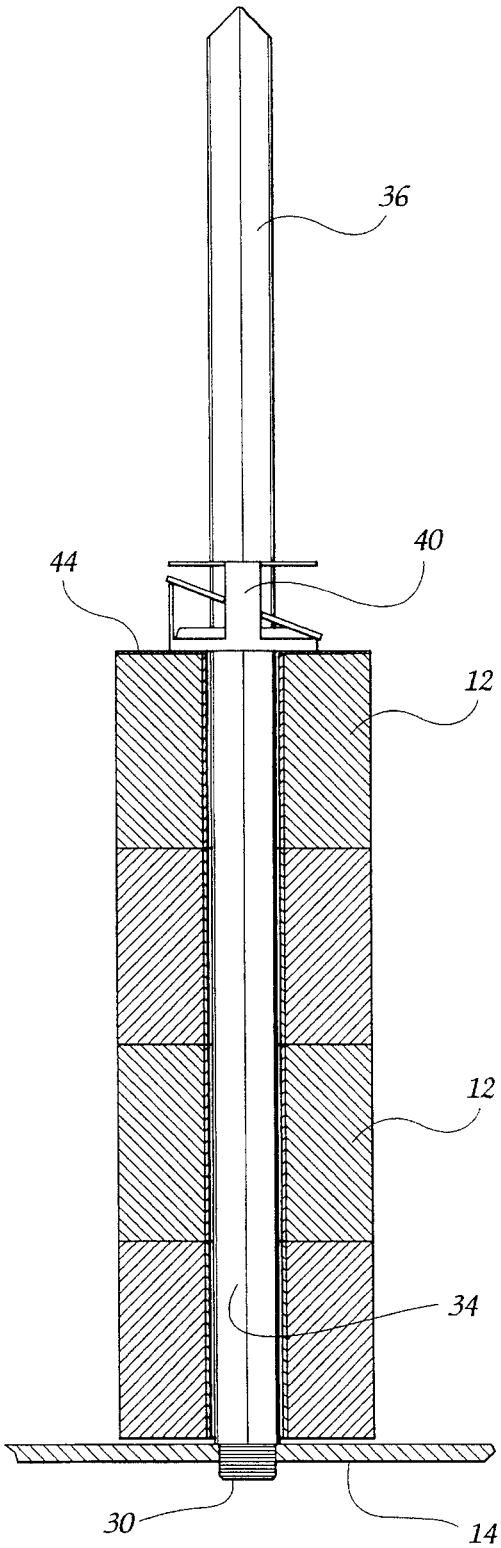
FIGS. 6 and 7, respectively, are vertical cross-sectional views taken through one post assembly of the carrier of FIG. 1, illustrating the arrangement of the post assembly and its associated cap when the carrier is selectively filled to differing levels with yarn packages.
Figure 7:
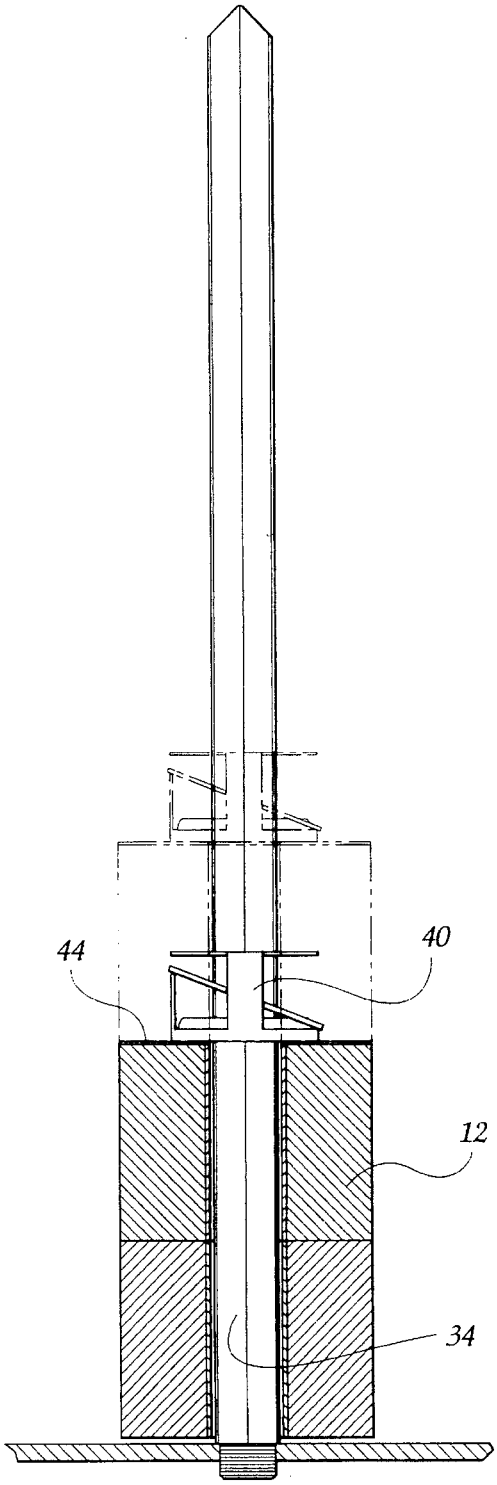

Hence, it will be understood that this unique construction of the cap 40 in the present invention enables each cap to be slidably mounted and demounted to and from an associated post assembly and to be moved selectively along the full length thereof to any desired latching position, which uniquely enables the carrier 10 of the present invention to operate effectively with any number of yarn packages 12 installed on its post assemblies up to the full maximum capacity of the carrier. Thus, once a stack of yarn packages 12 are placed on each post assembly 28, the package retaining cap 40 for each post assembly is slidably placed onto the package supporting portion 34 thereof and advanced therealong into retaining engagement with the uppermost package supported on the post assembly. By way of example, FIG. 1 depicts the carrier 10 with five yarn packages 12 installed on each post assembly 28, while FIGS. 6 and 7 contrastingly depict one post assembly 28 with lesser numbers of yarn packages 12, the cap 40 in each case being latched in place on the post assemblies in secure engagement with the uppermost package.

Of course, as those persons skilled in the art will readily recognize and understand, the package retaining cap 40 of the present invention may be of various alternative constructions utilizing a pivoted latching plate and substantially any configuration of aligned openings may be formed in the latching plates in correspondence to the cross-sectional configuration of the post assemblies on a carrier. For example, it is contemplated that a carrier may be equipped with post assemblies having an X-shaped cross-sectional configuration, in which case the base, top and latching plates of a cap in accordance with the present invention would be correspondingly configured with X-shaped openings. Alternatively, it is equally possible that the post assemblies of a carrier and the openings in the respective plates of a compatible cap may be formed of many various other configurations, without departing from the present invention. In each case, satisfactory operation would be accomplished so long as the latching plate pivots sufficiently to achieve bracing engagement with the post assembly. In addition, it will be recognized that the post assembly 28 could be of any desired length to handle any desired maximum number of yarn packages. These and other modifications and adaptations of the present invention are intended to be within the scope and substance of this invention.

With yarn packages 12 mounted on the post assemblies 28 in the manner described, the carrier 10 may be placed in a conventional horizontal-type textile package dyeing machine and wet processing treatment of the yarn packages 12 will proceed in essentially conventional fashion. Specifically, the treating liquid is permitted to flow freely between the upper liquid distribution chamber 20 and the axial interior area of the stacked columns of yarn packages by passing through the tubular mounting portions 30 of the post assemblies 28 and traveling along the post assemblies 28 between the struts 36 of the package supporting portion 34. Depending upon the direction of treating liquid circulation determined by the delivery and withdrawal of the treating liquid through the liquid distribution chambers 20,22, the treating liquid passes between the enclosure 18 and the annular interiors of the stacked package columns in either a radially inward or a radially outward direction. In either case, the progressive ongoing radial flow of the treating liquid through the packages 12 over the course of operation of the machine achieves the desired treatment of the yarn wound on the packages 12. The level of the treating liquid bath within the enclosure 18 can be reduced to the elevation of the cap directly above the stacked yarn packages to submerge the cap and thereby substantially prevent within the enclosure 18 above the package columns from entering the annular interior area of the stacked package columns. To facilitate such reduction of the liquid level within the carrier 10, the side wall 16 defining the enclosure 18 may be equipped with one or more removable or movable panels (not shown) by which the upper edge of the wall 16 may be effectively lowered at least one side of the carrier 10 or, alternatively, the side wall 16 could be replaceable in its entirety with another side wall of lesser height.

As will thus be understood, carriers in accordance with the present invention advantageously enable the liquid level of the treating bath within a textile package dyeing machine of either horizontal or vertical type, or any other appropriate textile wet treatment machine, to be effectively lowered to the elevation of the actual number of packages supported on the carrier whenever the carrier is loaded to less than its full capacity, without the prior necessity of utilizing any form of blocking element or volumetric displacement element and without the risk of drawing air into the pump of the treatment machine or the risk of potential contamination of the treatment bath. The cap of the present invention is especially advantageous in this regard because of its simple construction which is easy and relatively inexpensive to manufacture while also providing effective and reliable operation. In turn, the costs associated with using an excess of treating liquid and the accompanying environmental problems of reclaiming and/or disposing of used treatment liquid are effectively minimized.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A carrier insertable into a vessel of a wet treatment machine for selectively supporting diverse numbers of annular textile material packages during wet treatment operations, the carrier comprising a base, at least one post extending outwardly from the base for mounting selectively differing numbers of the textile material packages in series about the post to be centrally supported thereabout, and a package retaining cap for mounting on the post, the cap comprising a base having an opening for receiving the post and a latch plate having an opening for receiving the post, the latch plate being selectively movable between a disengaged position wherein the latch plate is disposed in spaced parallel relation to the base with their respective openings aligned with one another to permit the cap to be slidably mounted to and demounted from the post for selective slidable positioning movement relatively freely along the post to differing package retaining positions therealong into and out of engagement with the outermost one of the annular textile material packages supported on the post and an engaged position wherein the latch plate is disposed in a sufficiently angular relation to the base to be braced against the post at the opening in the latch plate to prevent unintended sliding movement of the cap along the post during a wet treatment operation.

2. A carrier for supporting textile material packages in a wet treatment machine according to claim 1, wherein the respective openings in the base and the latch plate of the cap conform closely to the configuration of the post.

3. A carrier for supporting textile material packages in a wet treatment machine according to claim 1, wherein the post is configured to permit liquid flow axially through the annular interior of the textile material packages.

4. A carrier for supporting textile material packages in a wet treatment machine according to claim 1, wherein the post includes a plurality of radially outwardly extending package supporting struts.

5. A carrier for supporting textile material packages in a wet treatment machine according to claim 1, wherein the base includes a liquid flow opening and the post includes an annular mounting portion affixed to the base about the liquid flow opening for liquid communication therethrough with the annular interior of the textile material packages supported on the post.

6. A carrier for supporting textile material packages in a wet treatment machine according to claim 5, wherein the base comprises a threaded bore defining the liquid flow opening and the mounting portion of the post comprises a threaded tube compatibly engageable in the threaded bore.

7. A carrier for supporting textile material packages in a wet treatment machine according to claim 1 and further comprising a plurality of the posts affixed to the base in spaced parallel relation to one another.

8. A carrier for supporting textile material packages in a wet treatment machine according to claim 1, wherein the carrier is configured for horizontal insertion into a horizontal-type wet treatment machine.

9. A package retaining cap for mounting on a post used in a carrier of the type insertable into a vessel of a wet treatment machine for selectively supporting diverse numbers of annular textile material packages during wet treatment operations, the cap comprising a base having an opening for receiving the post and a latch plate having an opening for receiving the post, the latch plate being selectively movable between a disengaged condition wherein the latch plate is disposed in spaced parallel relation to the base with their respective openings aligned with one another to permit the cap to be slidably mounted to and demounted from the post for selective slidable positioning movement relatively freely along the post to differing package retaining positions therealong into and out of engagement with the outermost one of the annular textile material packages supported on the post and an engaged condition wherein the latch plate is disposed in a sufficiently angular relation to the base to be braced against the post at the opening in the latch plate to prevent sliding movement of the cap along the post during a wet treatment operation.

10. A package retaining cap according to claim 9, wherein the respective openings in the base and the latch plate of the cap conform closely to the configuration of the post to essentially form a seal therebetween.

* * * * *